US008636608B2

(12) United States Patent
De la Cruz et al.

(10) Patent No.: US 8,636,608 B2
(45) **Date of Patent: *Jan. 28, 2014**

(54) GOLF CLUB WITH OPTIMUM MOMENTS OF INERTIA IN THE VERTICAL AND HOSEL AXES

(71) Applicant: Acushnet Company, Fairhaven, MA (US)

(72) Inventors: Noah De la Cruz, San Diego, CA (US); Charles E. Golden, Encinitas, CA (US); John Morin, Poway, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/714,160

(22) Filed: Dec. 13, 2012

(65) Prior Publication Data

US 2013/0102414 A1 Apr. 25, 2013

Related U.S. Application Data

(60) Division of application No. 13/238,678, filed on Sep. 21, 2011, now Pat. No. 8,333,668, which is a division of application No. 12/508,752, filed on Jul. 24, 2009, now Pat. No. 8,267,808, which is a continuation-in-part of application No. 12/339,326, filed on Dec. 19, 2008, now Pat. No. 8,025,591, which is a continuation-in-part of application No. 11/552,729, filed on Oct. 25, 2006, now Pat. No. 7,497,789.

(51) Int. Cl.
*A63B 53/04* (2006.01)

(52) U.S. Cl.
USPC ..... 473/345; 473/349

(58) Field of Classification Search
USPC ..... 473/324–350
See application file for complete search history.

(56) References Cited

U.S. PATENT DOCUMENTS

| | | | |
|---|---|---|---|
| 687,540 | A | 11/1901 | Palmer |
| 1,222,770 | A | 4/1917 | Kaye |
| 1,983,158 | A | 12/1931 | Young |
| 1,841,062 | A | 1/1932 | Schavoir |

(Continued)

*Primary Examiner* — Alvin Hunter
(74) *Attorney, Agent, or Firm* — Randy K. Chan

(57) ABSTRACT

A hollow golf club is provided having an outer shell and an inner frame. The outer shell comprises one or more lightweight members, such as the crown or the skirt, and preferably fits within an envelope of about 5 inches×5 inches×2.8 inches. The inner frame fits within a smaller envelope and sits on the sole of the club head. One or more weights are located either on or within the inner frame to optimize the moment of inertia of the club head about both the vertical axis running through the center of gravity or geometric center of the club head, hereinafter referred to as the "y-axis," and the axis running through the center of the shaft of the golf club, hereinafter referred to as the "hosel axis." The weights can be attached to the inner frame or can be distributed within the inner frame. In another embodiment, the hitting face and a portion of the skirt proximate the toe form a curved blade in the shape of a sickle or battle ax and an inner support bridges the toe end of the curved blade to the hosel for structural support. The ratio of moment of inertia of the club head about the y-axis to moment of inertia of the club head about the hosel axis is preferably 0.55. More preferably, this ratio is 0.75.

15 Claims, 12 Drawing Sheets

(56) References Cited

U.S. PATENT DOCUMENTS

| | | | |
|---|---|---|---|
| 1,867,103 | A | 7/1932 | Schavoir |
| 3,519,271 | A | 7/1970 | Smith |
| 3,980,301 | A | 9/1976 | Smith |
| 4,420,156 | A | 12/1983 | Campau |
| 4,471,961 | A | 9/1984 | Masghati et al. |
| 4,697,813 | A | 10/1987 | Inoue |
| 4,927,144 | A | 5/1990 | Stormon |
| 5,094,457 | A | 3/1992 | Kinoshita |
| 5,197,733 | A | 3/1993 | Schroder |
| 5,377,978 | A | 1/1995 | Lee |
| 5,435,551 | A | 7/1995 | Chen |
| 5,681,228 | A | 10/1997 | Mikame et al. |
| 5,722,901 | A | 3/1998 | Barron et al. |
| 5,851,160 | A | 12/1998 | Rugge et al. |
| 6,001,028 | A | 12/1999 | Tang et al. |
| 6,050,903 | A | 4/2000 | Lake |
| 6,080,068 | A | 6/2000 | Takeda |
| 6,299,546 | B1 | 10/2001 | Wang |
| 6,319,148 | B1 | 11/2001 | Tom |
| 6,425,832 | B2 | 7/2002 | Cackett et al. |
| 6,471,604 | B2 | 10/2002 | Hocknell et al. |
| 6,491,592 | B2 | 12/2002 | Cackett et al. |
| 6,547,676 | B2 | 4/2003 | Cackett et al. |
| 6,558,272 | B2 | 5/2003 | Helmstetter et al. |
| 6,565,452 | B2 | 5/2003 | Helmstetter et al. |
| 6,575,845 | B2 | 6/2003 | Galloway et al. |
| 6,582,323 | B2 | 6/2003 | Soracco et al. |
| 6,602,149 | B1 | 8/2003 | Jacobson |
| 6,607,452 | B2 | 8/2003 | Helmstetter et al. |
| 6,634,958 | B1 | 10/2003 | Kusumoto |
| 6,648,773 | B1 | 11/2003 | Evans |
| 6,679,782 | B2 | 1/2004 | Tang et al. |
| 6,716,110 | B1 | 4/2004 | Ballow |
| 6,991,558 | B2 | 1/2006 | Beach et al. |
| 7,137,905 | B2 | 11/2006 | Kohno |
| 7,147,572 | B2 | 12/2006 | Kohno |
| 7,166,038 | B2 | 1/2007 | Williams et al. |
| 7,198,575 | B2 | 4/2007 | Beach et al. |
| 7,410,428 | B1 | 8/2008 | Dawson et al. |
| 7,497,789 | B2 | 3/2009 | Burnett et al. |
| 7,722,477 | B2 | 5/2010 | Consiglio |
| 8,025,591 | B2 | 9/2011 | de la Cruz |
| 8,267,808 | B2 * | 9/2012 | De La Cruz et al. ..... 473/345 |
| 8,333,668 | B2 * | 12/2012 | De La Cruz et al. ..... 473/345 |

* cited by examiner

GOLF CLUB WITH OPTIMUM MOMENTS OF INERTIA IN THE VERTICAL AND HOSEL AXES

CROSS REFERENCE TO RELATED APPLICATIONS

This application is a divisional of U.S. patent application Ser. No. 13/238,678, filed Sep. 21, 2011, now U.S. Pat. No. 8,333,668, which is a divisional of U.S. patent application Ser. No. 12/508,752, filed Jul. 24, 2009, now U.S. Pat. No. 8,267,808, which is a continuation-in-part of U.S. patent application Ser. No. 12/339,326 filed on Dec. 19, 2008, now U.S. Pat. No. 8,025,591, which is a continuation-in-part of U.S. patent application Ser. No. 11/552,729, filed on Oct. 25, 2006, now U.S. Pat. No. 7,497,789. These applications are incorporated by reference herein in their entirety.

FIELD OF THE INVENTION

The invention relates to golf clubs, and more particularly, to metal wood and utility-type golf clubs having improved mass characteristics.

BACKGROUND OF THE INVENTION

The complexities of golf club design are known. The specifications for each component of the club (i.e., the club head, shaft, grip, and subcomponents thereof) directly impact the performance of the club. Thus, by varying the design specifications, a golf club can be tailored to have specific performance characteristics.

The design of club heads has long been studied. Among the more prominent considerations in club head design are loft, lie, face angle, horizontal face bulge, vertical face roll, center of gravity location, rotational moment of inertia, material selection, and overall head weight. While this basic set of criteria is generally the focus of golf club designers, several other design aspects must also be addressed. The interior design of the club head may be tailored to achieve particular characteristics, such as the inclusion of a hosel or a shaft attachment means, perimeter weights on the club head, and fillers within the hollow club heads.

Golf club heads must also be strong to withstand the stresses that occur during repeated collisions between the golf club and the golf balls. The loading that occurs during this transient event can create a peak force of over 2,000 lbs. Thus, a major challenge is to design the club face and club body to resist permanent deformation or fracture. Conventional hollow metal wood drivers made from titanium typically have a uniform face thickness exceeding 2.5 mm or 0.10 inch to ensure structural integrity of the club head.

Players generally seek a metal wood driver and golf ball combination that delivers maximum distance and landing accuracy. The distance a ball travels after impact is dictated by the magnitude and direction of the ball's initial velocity and the ball's rotational velocity or spin. Environmental conditions, including atmospheric pressure, humidity, temperature, and wind speed, further influence the ball's flight. However, these environmental effects are beyond the control of the golf equipment designers. Golf ball landing accuracy is driven by a number of factors as well. Some of these factors are attributed to club head design, such as center of gravity and moment of inertia.

The current trend in golf club manufacturing is to produce large volume club heads in order to maximize the moment of inertia of the club head. Concerned that improvements to golf equipment may render the game less challenging, the United States Golf Association (USGA), the governing body for the rules of golf in the United States, has specifications for the performance of golf equipment. These performance specifications dictate the size and weight of a conforming golf ball or a conforming golf club. USGA rules limit a number of parameters for drivers. For example, the volume of drivers has been limited to 460±10 cubic centimeters. The length of the shaft, except for putters, has been capped at 48 inches. The driver club heads must fit inside a 5-inch square and the height from the sole to the crown cannot exceed 2.8 inches. The USGA has further limited the coefficient of restitution of the impact between a driver and a golf ball to 0.830.

The USGA has also observed that the rotational moment of inertia of drivers, or the club's resistance to twisting on off-center hits, has tripled from about 1990 to 2005, which coincides with the introduction of oversize drivers. Since drivers with higher rotational moment of inertia are more forgiving on off-center hits, the USGA was concerned that further increases in the club head's inertia may reduce the challenge of the game, and instituted in 2006 a limit on the moment of inertia for drivers at 5900 $g\cdot cm^2 \pm 100$ $g\cdot cm^2$ (590 $kg\cdot mm^2 \pm 10$ $kg\cdot mm^2$) or 32.259 $oz\cdot in^2 \pm 0.547$ $oz\cdot in^2$.

The USGA limits moment of inertia for drivers, as the calculated moment of inertia with respect to a vertical axis through the center of gravity of the club head. Larger MOIs about the vertical axis preserve more ball speed on off-center impacts. However, when a golf club head approaches a golf ball during the downswing the golf club head rotates around the shaft or hosel of the club. The moment of inertia around this "hosel axis" tends to be significantly larger than the moment of inertia around the vertical axis through the center of gravity. The moment of inertia about the hosel or shaft axis is the rotational mass or "foot print" of the club that the golfer must work to overcome just prior to impact in order to hit a straight shot. In large-volume drivers manufactured to have large moments of inertia around the vertical axis, this difference in moment of inertia is even more exaggerated. Players may find it difficult to control a club head having a very large moment of inertia around the hosel axis, because it requires more work during the downswing to "square" the face and hit straight shots.

The '326 parent patent application teaches methods for optimizing the mass properties of golf club heads, having a smaller volume or smaller footprint, an optimized moment of inertia with respect to the hosel axis and/or an optimized rotational mass footprint. This parent patent application also teaches golf club heads having a large moment of inertia around the vertical axis through the center of gravity relative to a moment of inertia around the hosel axis.

However, there remains a need for a golf club head having an optimized or reduced rotational mass footprint while still possessing the shape and size of a full-sized club head.

SUMMARY OF THE INVENTION

One embodiment of the present invention is directed to a hollow body golf club head having an outer shell and an inner frame. The outer shell comprises one or more lightweight members, preferably on the crown, the skirt or the sole. Preferably, these lightweight members are made from low density metals, metal-polymer composites, reinforced plastics and plastics, among others. The inner frame is disposed within the outer shell and is preferably connected to the sole and the hitting face. The inner frame preferably fits within a 4 inches×4 inches×2.8 inches envelope and may carry discrete weights or masses. Such weights or masses are located away from the center of gravity or the geometric center of the club head to optimize the moment of inertia (MOI) of the club head about both the vertical axis running through the center of gravity or geometric center of the club head, hereinafter referred to as the "y-axis," and the axis running through the center of the shaft of the golf club, hereinafter referred to as the "hosel axis." In an alternative embodiment, the weights or masses can be distributed throughout the inner frame.

In another embodiment, the hollow golf club head comprises an outer shell and a hitting face. The hitting face and a portion of the skirt proximate the toe form a curved blade in the shape of a sickle or battle ax and an inner support bridges the toe end of the curved blade to the hosel for structural support.

A golf club head of the present invention preferably has a MOI about the y-axis between about 470 $kg \cdot mm^2$ and about 600 $kg \cdot mm^2$ and MOI about the hosel axis between about 600 $kg \cdot mm^2$ and about 725 $kg \cdot mm^2$.

According to an embodiment of the invention, the ratio of MOI(y-axis) to MOI(hosel axis) is preferably greater than about 0.55. More preferably, this ratio is greater than about 0.75. In certain embodiments, this ratio is greater than about 1.00, which means that advantageously MOI(hosel axis) can be lower than MOI(y-axis).

DETAILED DESCRIPTION

Rotational moment of inertia ("MOI" or "inertia") in golf clubs is well known in the art, and is fully discussed in a number of references, including U.S. Pat. No. 4,420,156, which is incorporated herein by reference in its entirety. When the inertia is too low, the club head tends to rotate excessively from off-center hits. A golf club head having a higher moment of inertia will resist rotation due to an off-center impact between the club face and a golf ball, thereby reducing loss of ball speed, mitigating the tendency for the ball to hook or slice and increasing flight distance and subsequently landing accuracy. The present invention is directed to a hollow body golf club head having a hosel, face, crown, skirt and sole, wherein the club head further comprises discrete concentrations of weight or mass located away from the center of gravity or the geometric center of the club head to optimize the moment of inertia (MOI) of the club head about both the vertical axis running through the center of gravity or geometric center of the club head, hereinafter referred to as the "y-axis," and the axis running through the center of the shaft of the golf club, hereinafter referred to as the "hosel axis." In particular, the present invention is directed to a metal-wood or utility golf club head having the above-described mass characteristics.

Current driver clubs have a volume of up to the USGA limit of 460 cc. Higher volume can lead to higher MOI (hosel axis), which demands more work from the golfer to control the club, such that the face is perpendicular to the target line at impact. Lowering the MOI(hosel axis) would reduce the physical demands on the golfer, while maintaining a high MOI(y-axis) would maintain the desirable forgiveness in ball speed reduction for off-center hits.

Figure 1:
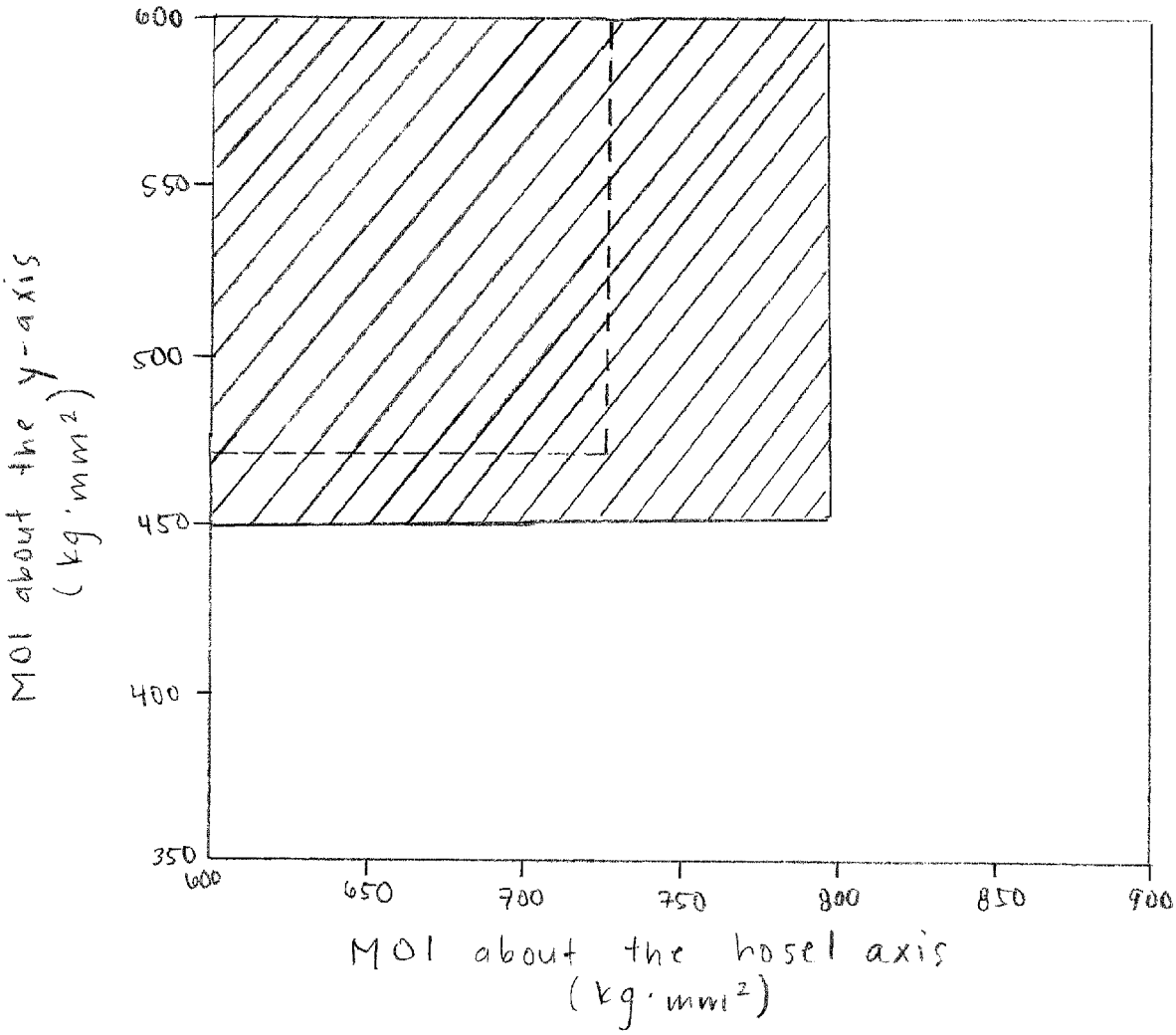
FIG. 1 is a graph showing the preferred ranges of moment of inertia about a y-axis and about a hosel axis for golf club heads of the present invention.

The golf club head of the present invention preferably has a volume between about 390 cc and about 420 cc. The inventor of the present invention has determined that the MOI(y-axis) is preferably between about 450 $kg \cdot mm^2$ to about 600 $kg \cdot mm^2$ and more preferably between about 470 $kg \cdot mm^2$ and about 600 $kg \cdot mm^2$. The MOI(y-axis) can further be between about 545 $kg \cdot mm^2$ and about 600 $kg \cdot mm^2$. The MOI(hosel axis) is preferably between about 600 $kg \cdot mm^2$ and 800 $kg \cdot mm^2$ and more preferably between about 600 $kg \cdot mm^2$ and about 725 $kg \cdot mm^2$. The shaded area of the graph of FIG. 1 shows the preferred range and the broken lines within the shaded area show the more preferred range of MOI values about both the y-axis and the hosel axis for golf club heads of the present invention. These preferred MOI(y-axis) and MOI (hosel axis) values represent less physical demands on the golfer during impacts with golf balls and maintaining desirable forgiveness in ball speed reduction for off-center hits.

Lower rotational footprint in accordance to the present invention can be achieved for club head having volumes up to and beyond about 460 cc, when the club head is made from multiple materials, including one or more plastics or when discretionary weight usable to affect changes in mass characteristics are moved inward spaced from the perimeter of the club head, as discussed below.

Additionally, the ratio of the MOI(y-axis) to the MOI(hosel axis) is preferably greater than about 0.55, but is more preferably greater than about 0.75. As shown below, this ratio can be greater than 1.00, which indicates that MOI(hosel axis) can be made lower than MOI(y-axis). This is another preferred embodiment of the present invention, because it preserves the desirable high MOI(y-axis) while minimizing the rotational foot print or MOI (hosel axis).

Another way to control the MOI(hosel axis) is to couple the MOI(y-axis) to the volume of the club head, since lowering the volume of the club head is one way of lowering the MOI(hosel axis). Preferably, the volume of the club head is greater than 350 cc, but is more preferably between about 390 cc and about 420 cc. The ratio of the MOI(y-axis) to the volume of the club head is preferably greater than about 1.30 $kg \cdot mm^2/cm^3$ for a club head having a volume of about 350 cc or greater. The ratio of the MOI(y-axis) to the volume of the club head is more preferably greater than about 1.45 $kg \cdot mm^2/cm^3$ and more preferably greater than about 1.50 $kg \cdot mm^2/cm^3$ for club heads with volume of about 350 cc or greater. Preferably, this ratio is less than about 1.70 $kg \cdot mm^2/cm^3$.

Yet another way to control the MOI (hosel axis) is to limit the distance of the center of gravity to be from about ⅔ inch to about 1 inch measured orthogonally from hitting face. Without being bound to any particular theory, in large or oversized driver clubs, the center of gravity can be located more than about 1 inch from the hitting face to provide a larger sweet spot on the hitting face. By limiting how far back the center of gravity can be located, i.e., from about ⅔ inch to about 1 inch from the hitting face, one can control the volume of the club and the MOI (hosel axis) of the club, while allowing the MOI (y-axis) to be between 450 kg·mm$^2$ and about 650 kg·mm$^2$, more preferably between 500 kg·mm$^2$ and 600 kg·mm$^2$.

The driver club of the present invention possesses substantially similar MOI properties of the larger 460 cc driver club but with smaller volume, and is easier for golfers to control during the downswing.

In accordance with one aspect of the present invention, the weight can be distributed around the club head in an inventive manner to achieve the desirable MOI(y-axis) to MOI(hosel axis) ratio and/or the desirable MOI(y-axis) to club head volume factor. For objects rotating about a known axis of rotation, moment of inertia I can be calculated using the following equation:

$$I=mr^2$$

where m is the mass of the object and r is the distance of that mass from the axis of rotation.

The MOI of a rectangular object about an axis can be described by the equation $$I=1/12\cdot m(\alpha^2+b^2)$$

where α is the length of the rectangle is and b is the width of the rectangle.

When MOI must be calculated about an axis of rotation going through a point other than the center of mass, one can determine MOI using the parallel axis theorem. The MOI of such an object can be calculated using the equation $$I=mr^2+me^2$$

where e is the distance of the center of mass of the object from the axis of rotation. The above equations were used to determine MOI values of the idealized golf club heads shown in FIGS. 2, 4, 6, 8 and 10.

The golf club head of the present invention may utilize a number of mass distribution patterns, including those shown in FIGS. 2, 4, 6, 8 and 10, to optimize MOI(y-axis) and the MOI(hosel axis). The mass characteristics of each idealized club head are summarized in Table 1. The idealized club heads of FIGS. 2, 4, 6, 8 and 10 fit into the prescribed USGA-prescribed 5-inch square and have a mass of 200 grams. For each pattern of mass distribution, 200 grams of mass were divided into two portions of the club head, portion A and portion B. In one iteration, portion A contains two-thirds, or 133 grams, of the mass of the club head, while portion B contains one-third, or 67 grams, of the mass of the club head. In a second iteration, portion A contains three-fourths, or 150 grams, of the mass of the club head, while portion B contains one-fourth, or 50 grams, of the mass of the club head. For each idealized club head, the y-axis runs through the geometric center of the club head. In this illustration, mass portions A and B are located adjacent to the perimeter of the 5 inch by 5 inch envelope prescribed by the USGA. Table 1 shows MOI values about both a y-axis running through the geometric center and the hosel axis of an idealized golf club head. The hosel axis of the club heads shown in FIGS. 2, 4, 6, 8 and 10 runs through point C. For FIGS. 2, 4, 6 and 8, point C is located 4 inches from toe edge 18 and 0.5 inches from face edge 20. For FIG. 10, point C is located 4.5 inches from toe edge 18 and 0.5 inches from face edge 20. Table 1 provides the ratio of the MOI(y-axis) to the MOI(hosel axis) for each iteration of mass distribution, as well as the ratio of MOI(y-axis) to volume for each iteration of mass distribution

TABLE 1

Figure 2:
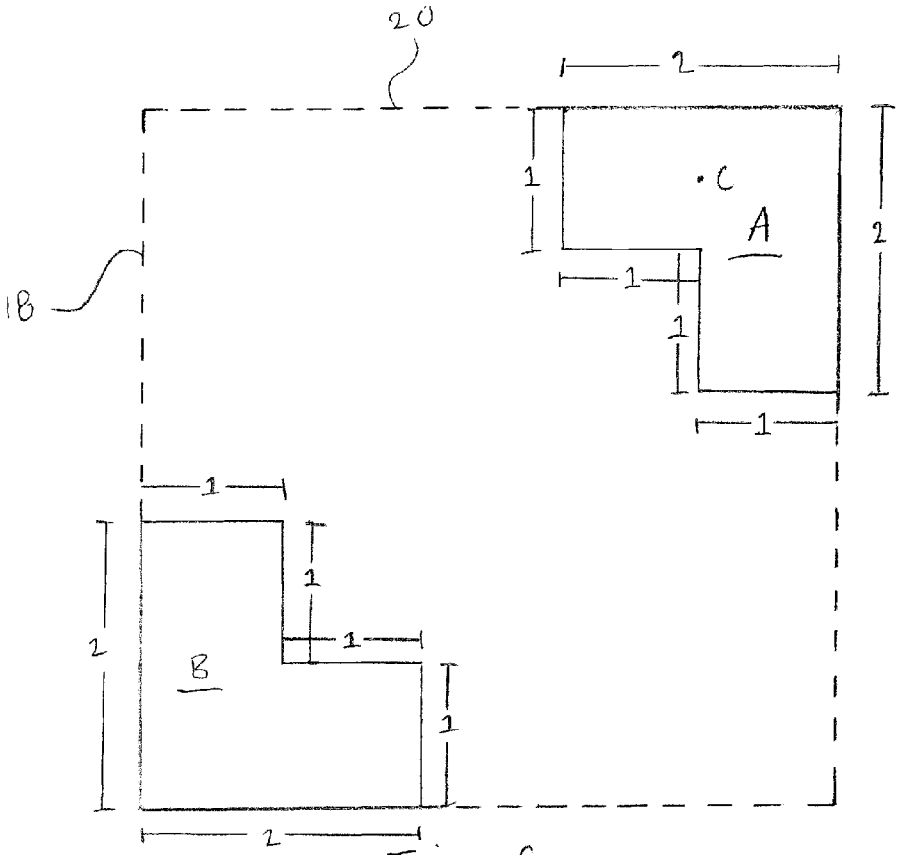
FIGS. 2, 4, 6, 8 and 10 are bottom plan views of idealized golf club heads of the present invention.
Figure 3:
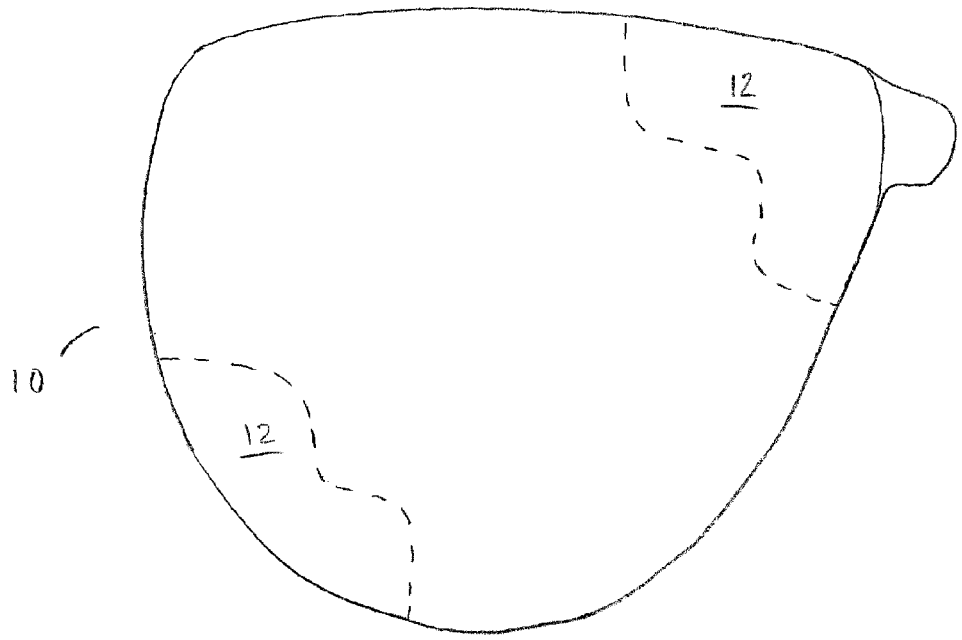
FIGS. 3, 5, 7, 9 and 11 are bottom plan views of golf club heads according to the present invention.
Figure 4:
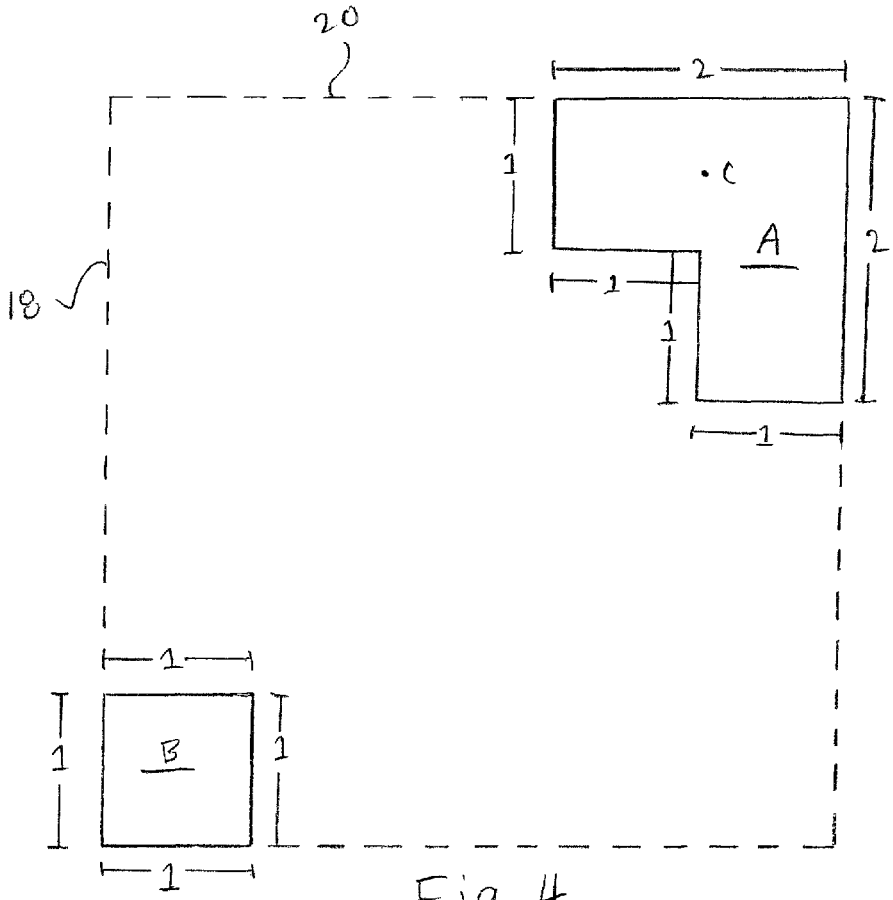
Figure 5:
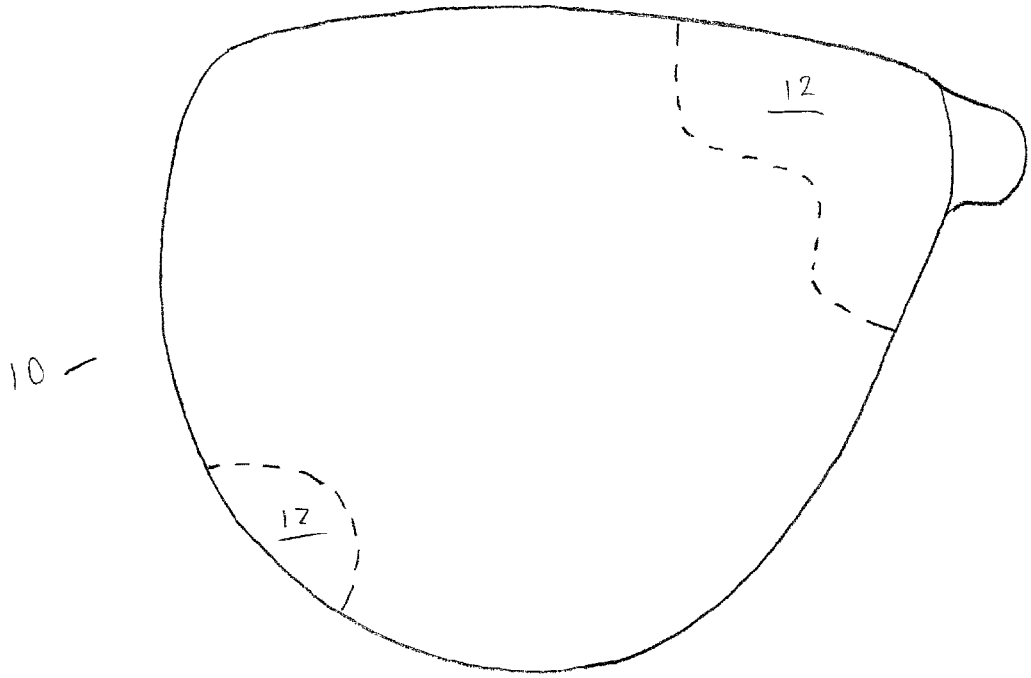
Figure 6:
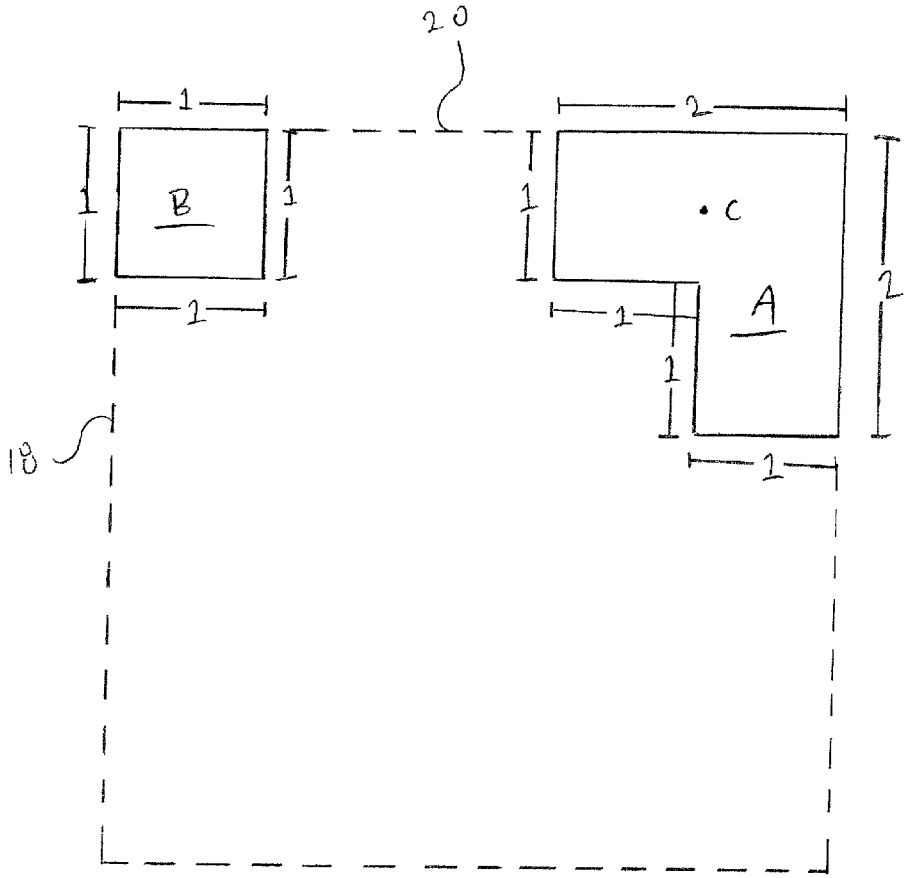
Figure 8:
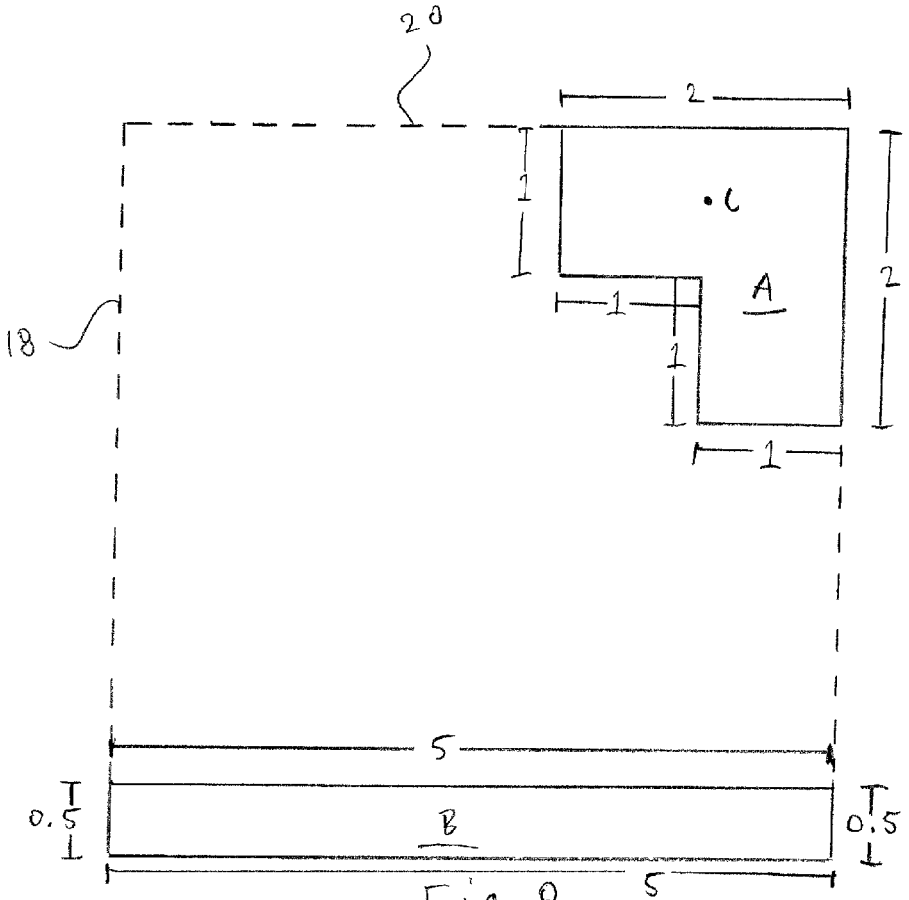
Figure 9:
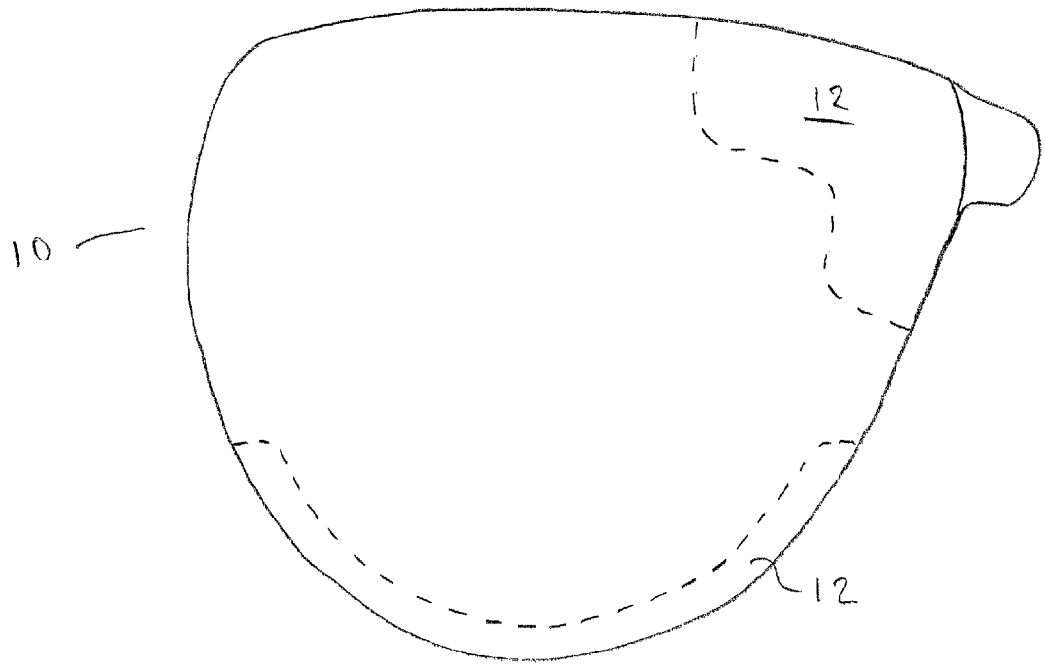
Figure 10:
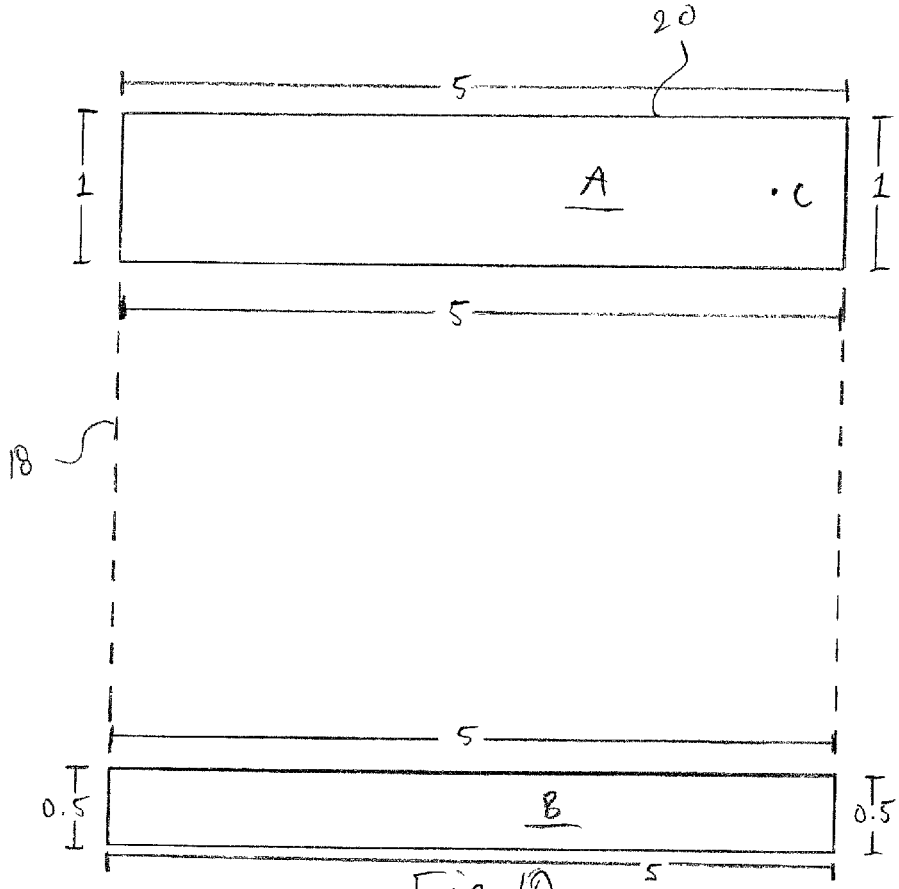
Figure 11:
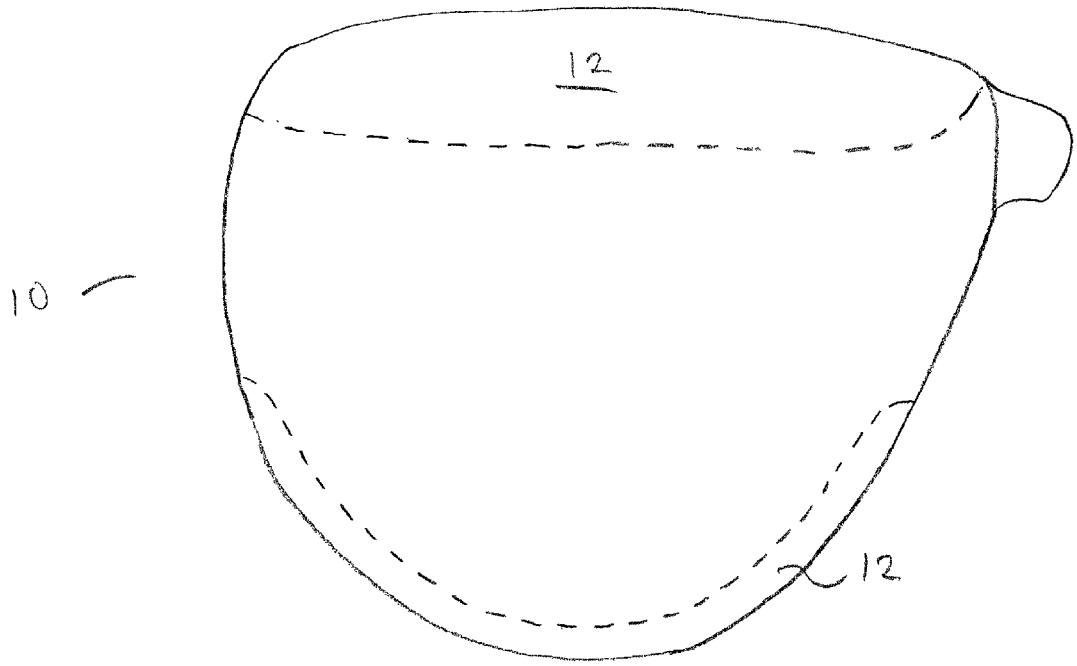

| | M(club head) | m(A) | m(B) | MOI (y-axis) | MOI (hosel axis) | MOI(y-axis)/MOI | MOI(y-axis)/volume | | |
|---|---|---|---|---|---|---|---|---|---|
| | [g] | [g] | [g] | [kg · mm$^2$] | [kg · mm$^2$] | (hosel axis) | 390 cc | 420 cc | 460 cc |
| FIG. 2 | 200 | 133 | 67 | 793.69 | 1097.62 | 0.72 | 2.04 | 1.89 | 1.73 |
| | 200 | 150 | 50 | 793.69 | 847.36 | 0.94 | 2.04 | 1.89 | 1.73 |
| FIG. 4 | 200 | 133 | 67 | 879.41 | 1283.48 | 0.69 | 2.25 | 2.09 | 1.91 |
| | 200 | 150 | 50 | 857.98 | 986.74 | 0.87 | 2.20 | 2.04 | 1.87 |
| FIG. 6 | 200 | 133 | 67 | 879.50 | 597.06 | 1.47 | 2.26 | 2.09 | 1.91 |
| | 200 | 150 | 50 | 858.05 | 471.94 | 1.82 | 2.20 | 2.04 | 1.87 |
| FIG. 8 | 200 | 133 | 67 | 836.60 | 1026.12 | 0.82 | 2.15 | 1.99 | 1.82 |
| | 200 | 150 | 50 | 825.88 | 793.73 | 1.04 | 2.12 | 1.97 | 1.80 |
| FIG. 10 | 200 | 133 | 67 | 836.61 | 1333.58 | 0.63 | 2.15 | 1.99 | 1.82 |
| | 200 | 150 | 50 | 825.89 | 1148.55 | 0.72 | 2.12 | 1.97 | 1.80 |

As shown in the table above, a club head fitting snugly inside a 5-inch square having a mass of 200 grams and mass distributions as depicted in FIGS. 2, 4, 6, 8 and 10 meet the preferred ratio of MOI(y-axis) to MOI(hosel axis). However, the calculated MOI(y-axis) values are higher than the 590 kg·mm$^2$ USGA limit for the idealized shapes, it is expected that for commercial club head, see e.g., FIGS. 3, 5, 7, 9 and 11, the MOI(y-axis) would be within the USGA limit due to the smaller footprints of the commercial club heads. Another way to reduce the MOI (y-axis) is to reduce the mass of areas "B" in FIGS. 2, 4, 6, 8 and 10.

Alternatively, for lower volume club heads, such as those having volumes between 390 cc and 420 cc, mass areas "B" is moved toward mass area "A" such that the club head fits snugly inside a 4-inch by 4-inch envelope. Point "C" would be located 3 inches from toe edge 18 and 0.5 inch from face edge 20 for FIGS. 2, 4, 6 and 8, and be located 3.5 inches from toe edge 18 and 0.5 inch from face edge 20 for FIG. 10. Table 2 provides the ratio of MOI(y-axis) to MOI(hosel axis) and the ratio of MOI(y-axis) to volume for this configuration.

TABLE 2

| | M(club head) | m(A) | m(B) | MOI (y-axis) | MOI (hosel axis) | MOI(y-axis)/MOI | MOI(y-axis)/volume | | |
|---|---|---|---|---|---|---|---|---|---|
| | [g] | [g] | [g] | [kg · mm$^2$] | [kg · mm$^2$] | (hosel axis) | 390 cc | 420 cc | 460 cc |
| FIG. 2 | 200 | 133 | 67 | 430.00 | 665.00 | 0.55 | 1.10 | 1.02 | 0.93 |
| | 200 | 150 | 50 | 430.74 | 523.45 | 0.82 | 1.10 | 1.03 | 0.94 |
| FIG. 4 | 200 | 133 | 67 | 487.61 | 730.57 | 0.67 | 1.25 | 1.16 | 1.06 |
| | 200 | 150 | 50 | 473.97 | 572.37 | 0.83 | 1.22 | 1.13 | 1.03 |
| FIG. 6 | 200 | 133 | 67 | 487.61 | 341.63 | 1.43 | 1.25 | 1.16 | 1.06 |
| | 200 | 150 | 50 | 473.97 | 280.00 | 1.69 | 1.22 | 1.13 | 1.03 |
| FIG. 8 | 200 | 133 | 67 | 476.80 | 622.53 | 0.77 | 1.22 | 1.14 | 1.04 |
| | 200 | 150 | 50 | 465.86 | 491.35 | 0.95 | 1.19 | 1.11 | 1.01 |
| FIG. 10 | 200 | 133 | 67 | 505.00 | 926.76 | 0.54 | 1.29 | 1.20 | 1.10 |
| | 200 | 150 | 50 | 498.59 | 814.74 | 0.61 | 1.28 | 1.19 | 1.08 |

The MOI(y-axis) values for a 4-inch by 4-inch envelope are all under the USGA limit of 590 kg·mm$^2$. This design envelope can be enlarged to about 4.5-inch by 4.5-inch design envelope without exceeding the USGA limit. The ratio of MOI(y-axis) to MOI(hosel axis) is greater than about 0.55, preferably greater than about 0.75. Advantageously, in accordance with the present invention, the embodiment of FIG. 6 shows that the MOI(hosel axis) can be designed to be lower than the MOI(y-axis), i.e., the rotational foot print can be reduced while maintaining a high MOI (y-axis) to limit the adverse effects of off-centered hits. In other words, the ratio of MOI(y-axis) to MOI(hosel axis) is greater than about 1.00.

The ratio of MOI(y-axis) to club head volume for this embodiment is from about 0.90 kg·mm$^2$/cm$^3$ to about 1.30 kg·mm$^2$/cm$^3$. This ratio is preferably greater than about 0.90 kg·mm$^2$/cm$^3$, more preferably greater than 1.00 and more preferably greater than about 1.10. In one example, for club heads that can fit inside a 4.5-inch by 4.5-inch design envelope, this ratio can be greater than about 1.20, preferably greater than about 1.40 and more preferably greater than about 1.60. This ratio should be less than about 1.70 kg·mm$^2$/cm$^3$.

In accordance to another aspect of the present invention, MOI(hosel axis) of less than about 850 kg·mm$^2$, which is believed to be the amount of rotational mass that can be controlled by better players or low handicapped players, while maintaining MOI(y-axis) at more than 470 kg·mm$^2$. For higher handicapped players, the MOI(hosel axis) should be kept to about 750 kg·mm$^2$ or less. On the other hand, the present invention allows MOI (hosel axis), MOI (y-axis) and any of the ratios discussed herewithin to be customized for any individual player after proper fittings.

FIGS. 3, 5, 7, 9 and 11 show driver-style club head 10 having concentrated areas of mass 12 allocated on the sole in patterns similar to those of the idealized club heads of FIGS. 2, 4, 6, 8 and 10, respectively. A club head of the present invention may have a pattern of mass distribution on the sole of the club head as shown in FIGS. 3, 5, 7, 9 and 11. Concentrated areas of mass 12 are located on the sole of golf club 10 to cause the center of gravity of the club to remain relatively low. In order to maximize MOI about a vertical axis running through the center of gravity or through the geometric center of the club head, and to minimize the MOI about the axis running through the shaft and hosel of the club head, mass may be allocated on the sole of the club head in regions around the base of the hosel, as shown in FIGS. 3, 5, 7 and 9. To control the location of the center of gravity, the sole may include other concentrated areas of mass, such as toward the back and toe as in FIGS. 3 and 5. Alternatively, other areas of mass may be located toward the face and toe as in FIG. 7, or toward the back as in FIG. 9. A "pseudo I-beam" pattern of mass distribution wherein mass is concentrated toward the face edge and toward the back, as in FIG. 11, may also be utilized.

The weight distribution data and conclusions presented above and in Tables 1 and 2, and FIGS. 2-11 are for illustration only and do not limit the scope of the present invention. MOI(y-axis) values were calculated about the geometric center for ease of illustration, since, unlike the centers of gravity, the geometric center does not change when the masses A and B are moved around. Furthermore, 5-inch by 5-inch square and 4-inch by 4-inch square design envelopes are used for the illustration; however, when smaller volume club heads are used as discussed below an intermediate size or smaller envelope may be used. Those of ordinary skill in the art can follow the procedure described herein to design driver club heads that are within the scope of the present invention.

Areas of concentrated mass, such as portions A and B of the club heads of FIGS. 2, 4, 6, 8 and 10; areas 12 of the golf club heads of FIGS. 3, 5, 7, 9 and 11; and other discrete portions of mass in the golf club heads may comprises high density metals such as stainless steel, tungsten or iron. These areas may also comprise high density polymer composite. The material surrounding these concentrated areas of mass preferably comprises a less dense material, for instance metals such as aluminum, stainless steel, magnesium or titanium, or a polymer composite with high density fillers such as tungsten powder. Alternatively, areas of concentrated mass may comprise the same material as that surrounding the area of concentrated mass, however having a greater thickness than the surrounding material.

In another embodiment of the present invention, club head 10 comprises multiple materials with a section of the club head comprises the lightest material of the club head. The parent application discloses a wood-type club head with weights from the crown, sole and skirt moved aft or to the perimeter to maximize the MOI of the club head. More specifically, the mid-section of said club head is made from a lightweight material, such as carbon fiber composites, thermoplastic or thermoset polymers or lightweight metals. It had been shown in the parent application that a 460 cc/200 g club head made from titanium hitting cup, titanium aft cup and carbon fiber tube mid-section can achieve significantly better c.g. position and MOI properties than the same club made out of titanium alone.

All of the multi-material club heads disclosed in the parent case can be used in the current invention, preferably with the volume reduced to about 390 cc-420 cc, to achieve the preferred MOI(y-axis)/MOI(shaft axis) and MOI(y-axis)/volume ratios, described above.

Figure 12:
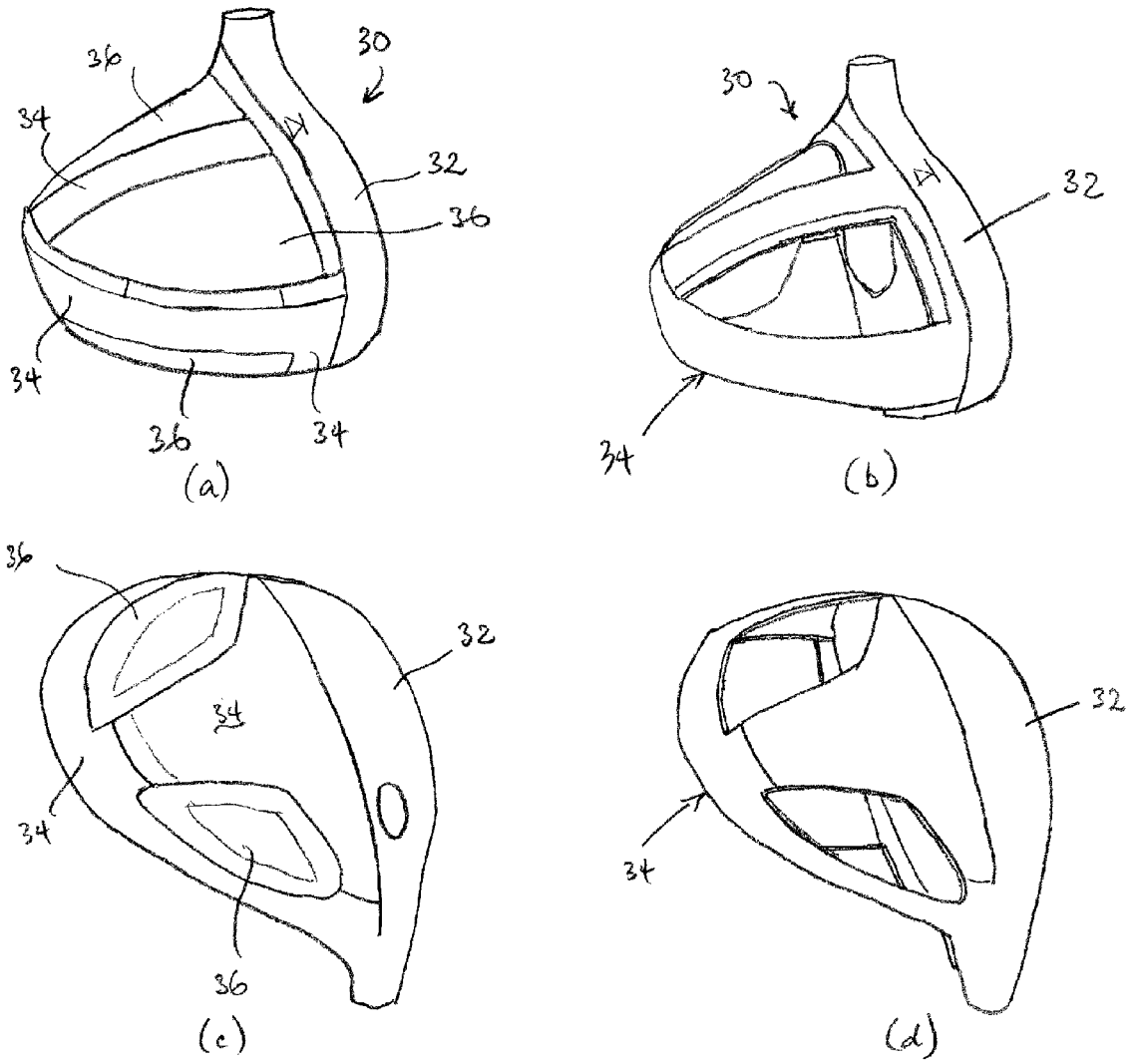
FIG. 12A is a top perspective view of a multi-material driver club of the present invention.
FIG. 12B is similar to FIG. 12A with portions removed for better clarity.
FIG. 12C is the bottom perspective view of the club head of FIG. 12A.
FIG. 12D is the bottom perspective view of the club head of FIG. 12B.

Another inventive multi-material club head is shown in FIGS. 12A-12D. FIG. 12A shows club head 30 made from three different materials. Club head 30 comprises hitting cup 32, which includes the hitting face, frame section 34, which includes crown and sole bridges/connectors and crown and sole plates 36. Hitting cup 32 is made from the material with the highest specific gravity, such as titanium, stainless steel, magnesium. Frame 34 is made from a material that is lighter than the material of hitting cup 32 but heavier than the material of the crown and sole plates 36. Preferably, frame 34 is sufficiently sturdy to provide support for the crown and sole plates 36, and to retain the shape of club head 30. Frame 34 can be made out of aluminum, magnesium, or reinforced or unreinforced plastic/polymer. Crown and sole plates 36 are made from the lightest material in club head 30, such as aluminum or reinforced or unreinforced plastic/polymer to allow more weight to be deployed near the hitting face and the back of the club head to achieve the preferred MOI(y-axis)/MOI(shaft axis) and MOI(y-axis)/volume ratios.

FIGS. 12B and 12D shows club head 30 without the crown and sole plates to more clearly show hitting cup 32 and frame 34. FIG. 12C shows the bottom view of club head 30 to illustrate more clearly sole plates 36.

Suitable plastics/polymers for use in club head 30 include polyetheretherketone (PEEK) commercially available as Tecapeek™ from Ensinger, Inc. from Washington, Pa. Preferably, a 30% glass or carbon reinforced PEEK, which has increased tensile strength, is used to increase the mechanical strength of the plastic. Relevant properties of some of the preferred materials are summarized below.

| Material | Density (g/cc) | Tensile Strength (MPa) | Hardness (Rockwell M) | Elongation Modulus (GPa) |
|---|---|---|---|---|
| Tungsten | 19.3 | | | 400 |
| Stainless Steel | 7.8 | | | 210 |
| 6-4 Titanium | 4.5 | | | 110 |
| Aluminum | 2.7 | | | 70 |
| PEEK 30% carbon reinforced | 1.44 | 208 | 107 | 13 |
| PEEK 30% glass reinforced | 1.49 | 157 | 103 | 9.7 |
| PEEK | 1.32 | 97 | 99 | 3.6 |

Other suitable plastics include, but are not limited to

| Plastics | Density (g/cc) | Shore D Hardness | Rockwell Hardness | Tensile Strength (MPa) | Elongation Modulus (GPa) |
|---|---|---|---|---|---|
| Acrylonitrile Butadiene Styrene (ABS), impact grade, molded | 1.02-1.2 | | 103M | 28-138 (avg. ~50) | 1.4-2.8 |
| ABS + 10% cellulose fibers (CF) | 1.08 | 70 | 105M | 43.1 | 3.5 |
| Polyetherimide (PEI) | 1.27 | 75 | 109M | 104.9 | 3.1 |
| PEI + 5% cellulose fibers (CF) | 1.32 | 75-80 | 109M | 104.9 | 3.1 |
| Nylon 66 + 20% CF | 1.14-1.49 | | 120R | 230 | 2.21-17 |
| Polypropylene (PP) | 0.886 | | 92R | 33.1 | 1.31 |

Exemplary multi-material club heads 30 having a volume of 410 cc made from various preferred materials are illustrated below.

| Hitting cup 32 | Frame 34 | Crown/Sole Plates 35 | Mass (g) | MOI (y-axis) kg · mm$^2$ | MOI (y-axis)/ volume |
|---|---|---|---|---|---|
| Titanium | Titanium | Titanium | 197 | 416 | 1.01 |
| Titanium | Titanium | Plastic | 197 | 449 | 1.10 |
| Titanium | Aluminum | Aluminum | 197 | 456 | 1.11 |
| Titanium | Aluminum | Plastic | 197 | 470 | 1.15 |
| Titanium | Plastic | Plastic | 197 | 484 | 1.18 |

As demonstrated, club head 30 made from multi-materials can achieve significant MOI (y-axis) while retaining a smaller volume or footprint.

Figure 13:
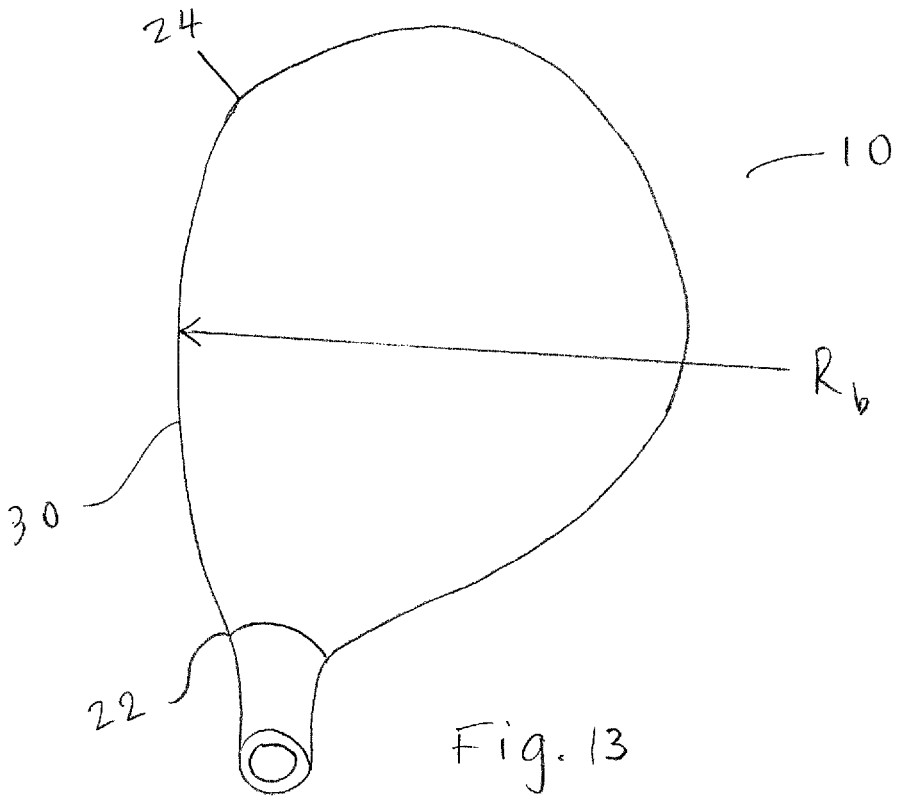
FIG. 13 is a top plan view of a golf club head of the present invention.
Figure 14:
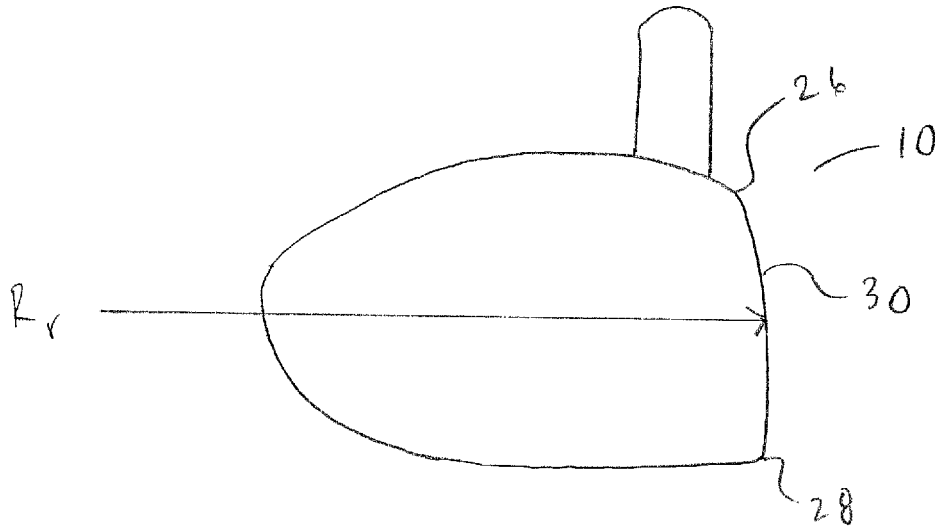
FIG. 14 is a cross-sectional view of a golf club head of the present invention

According to another embodiment of the present invention, and as shown in FIG. 13, golf club head 10 comprises an exterior surface having a horizontal bulge radius, defined as a radius of curvature $R_b$, extending from heel 22 to toe 24 and measured along the horizontal midline between the top and bottom of face 30. Golf club head 10 further comprises a vertical roll radius, shown in FIG. 14 and defined as a radius of curvature $R_r$, extending from top 26 to bottom 28 of face 30 and measured along the vertical midline between the toe and heel edges of face 30. A golf club head of the present invention having a MOI about the y-axis equal to or greater than about 450 kg·mm$^2$ and less than about 500 kg·mm$^2$ preferably has a horizontal bulge radius of about 12 inches and a vertical roll radius of about 10 inches. A golf club head having a MOI about the y-axis equal to or greater than about 500 kg·mm$^2$ and less than about 550 kg·mm$^2$ preferably has a horizontal bulge radius of about 13 inches and a vertical roll radius of about 10 inches. A golf club head having a MOI about the y-axis equal to or greater than about 550 kg·mm$^2$ preferably has a horizontal bulge radius of about 14 inches and a vertical face roll radius of about 10 inches.

Figure 15:
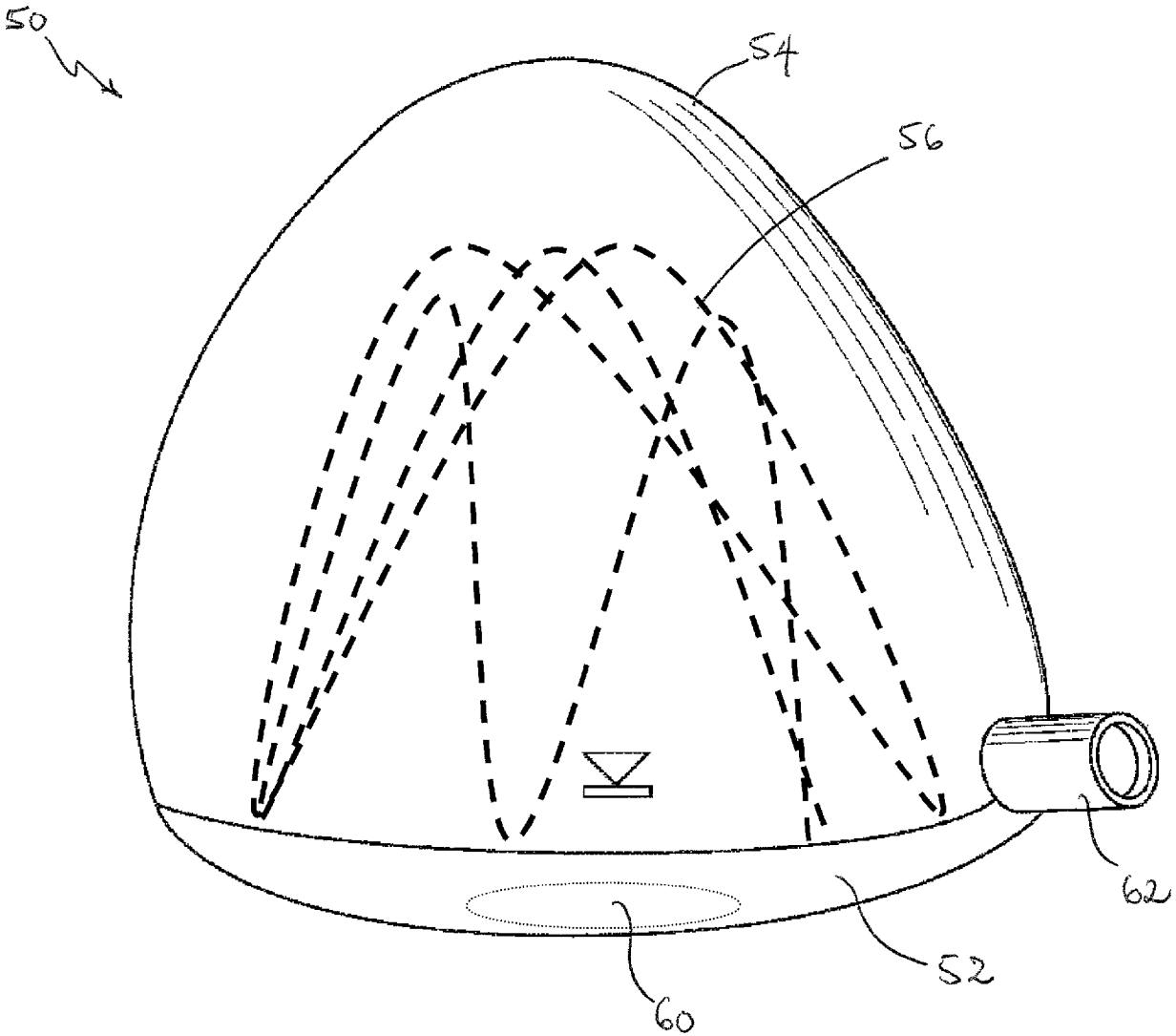
FIG. 15 is a top view of another embodiment of the present invention showing a club head with an outer shell and an inner frame
Figure 16:
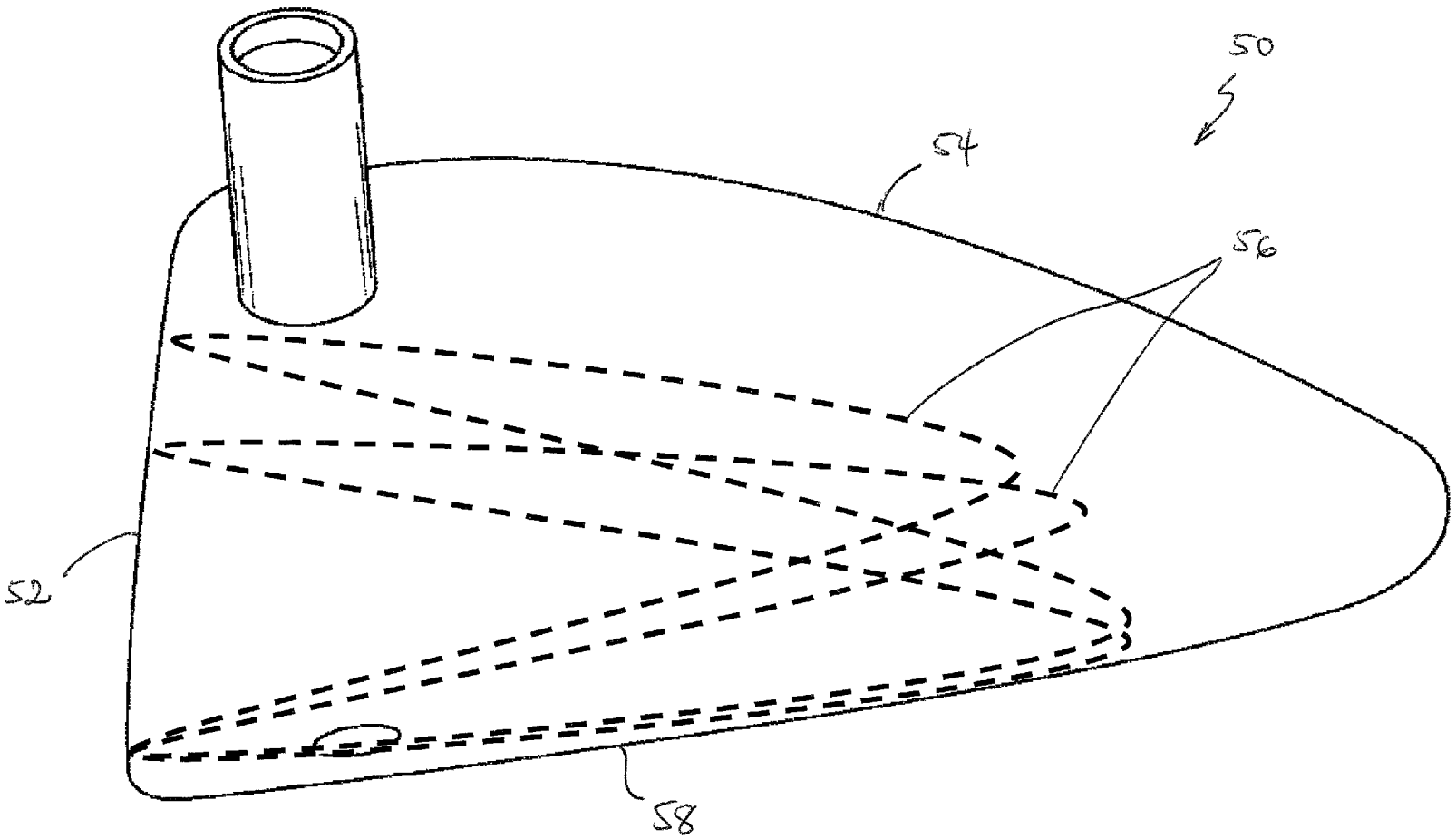
FIG. 16 is a side view of the embodiment of FIG. 15.

Referring to FIGS. 15 and 16, another embodiment of the present invention is illustrated. Club head 50 preferably is a full-sized club head, i.e., has a volume from about 420 cc to about 460 cc and preferably about 460 cc. Club head 50 comprises hitting face 52, outer shell 54 and inner frame 56. Preferably, outer shell 54 fits within an envelope of 5 inches×5 inches×2.8 inches prescribed by the USGA, and inner frame 56 fits within a smaller envelope of 4 inches×4 inches×2.8 inches. The smaller envelope as discussed above and in the '326 parent patent application can provide club heads optimized MOIs in the vertical and hosel axes.

To optimize MOI, outer shell 54 is made from strong lightweight materials, such as metal plastic composites, carbon fiber composites, aluminum, reinforced or unreinforced plastics, e.g., PEEK, carbon fiber/glass fiber reinforced PEEK, ABS, ABS(CF), PEI, PEI(CF), Nylon 66 (CF) or PP, described above. Lightweight materials can be used as part of the crown, skirt and the sole. Preferably, the sole is reinforced as described below to withstand impacts with the ground during play. Discretionary weights available from using lightweight materials are distributed throughout inner frame 56 or are attached as discrete weight(s) A and/or B to inner frame 56.

Discrete weights A and B can be attached in similar manners shown in FIGS. 2-11, except that these weights are attached to inner frame 56 instead of to the sole, hitting face or back as shown. Since the sole has to withstand multiple impacts with the ground during play, the sole especially when made from lightweight material is supported by inner frame 56. As best shown in FIG. 16, inner frame 56 is disposed on sole 58 to advantageously provide structural support to the sole. Inner frame 56 is preferably made from strong, resilient materials such as metals, e.g., stainless steel, aluminum, titanium. Metals with high specific gravity are preferred when the discretionary weights are distributed throughout inner frame 56. Metals with lower specific gravity are preferred when the discretionary weights are discrete weights A and B attached to inner frame 56. In a preferred embodiment, not including the hitting face the weight of inner frame 56 is higher than the weight of outer shell 54.

One advantage of using a lightweight outer shell 54 and inner frame 56 with discretionary weights disposed thereon is that club head 50, which is preferably a full-sized club head having a volume up to 460 cc can have optimized MOIs in the vertical and hosel axes of a club head with a smaller foot print, described above and in the '326 parent application.

As best shown in FIG. 15, inner frame 56 is substantially centered with respect to hitting face 52 in the toe-heel direction. Due to this relative positioning, sweet spot 60 is located at substantially the same distance from hosel 62 in inventive club head 50 as in conventional 460 cc club head, as best illustrated by outer shell 54. The advantage of having sweet spot 60 substantially in the same location as the sweet spot in conventional full-sized club head is that the learning curve for golfers switching from conventional full-sized club head to inventive club head 50 to take advantage of optimized MOIs is minimal, because the golfers can address the balls the same way and drive the balls with the same swing. Visually, inventive club head 50 has the same appearance as a full-sized club head.

Preferably, the MOIs in the vertical and hosel axes and MOI ratios for club head 50 with inner frame 56 are preferably similar to those listed in Table 2.

Figure 17:
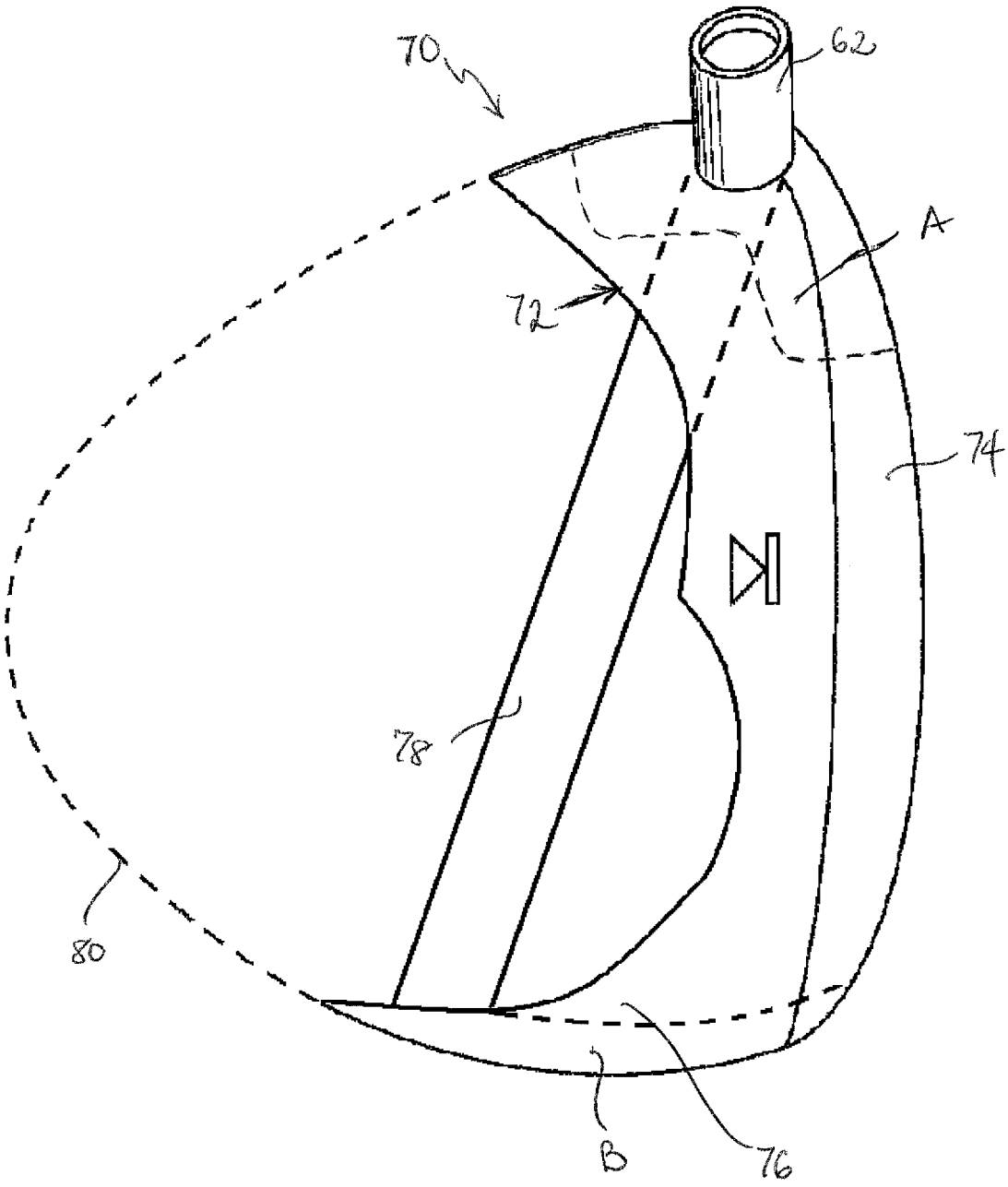
FIG. 17 is a top cut-away view of another embodiment of the present invention showing a club head having a curved blade hitting face.

Referring to FIG. 17, another embodiment of the present invention is shown. Club head 70 comprises hitting cup 72, which includes hitting face 74 and wing 76, which is formed from a portion of the skirt proximate to the toe of the club head. Hitting face 74 and wing 76 visually have the form of a curved blade, a sickle or battle ax. Club head 70 further comprises inner bridge 78 that connects hosel 62 to wing 76. Inner bridge 78 assists hitting cup 72 resisting deformation caused by a moment about hosel 62 from impacts with golf balls. Advantageously, inner bridge 78 can be a shock absorber to decrease the vibration of wing 76 caused by impacts with golf balls. Alternatively, inner bridge 78 may comprise multiple telescopic members supported by helical or leaf spring disposed therewithin to absorb vibration. Alternatively, inner bridge 78 can be a leaf spring. Furthermore, inner bridge 78 can be curved and has a concave shape relative to hitting face 74 to resist bending of wing 76.

Figure 7:
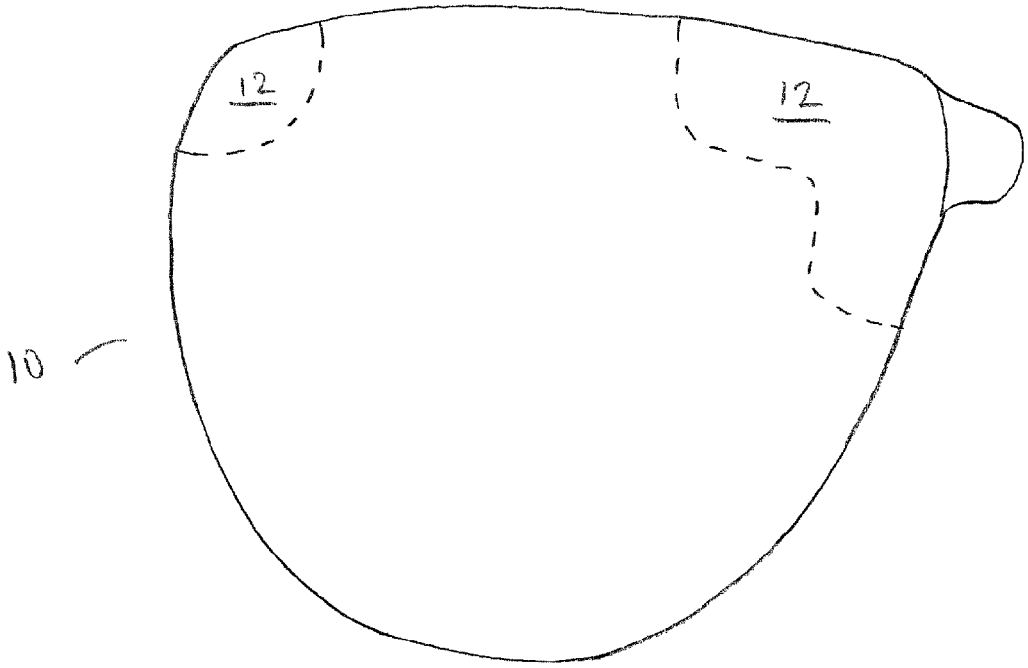

Discrete weight A can be added near hosel 62 and discrete weight B can be added at wing 76, similar to the embodiments shown in FIGS. 6 and 7 to optimize MOIs about the vertical and hosel axes. Preferably, club head 70 fits within a 4 inches×4 inches×2.8 inches envelope or a 4.5 inches×4.5 inches×2.8 inches envelope, and the MOIs in the vertical and hosel axes and MOI ratios for club head 70 are preferably similar to those listed in Table 2. Club head 70 further comprises outer shell 78 of lightweight materials discussed above.

Figure 18:
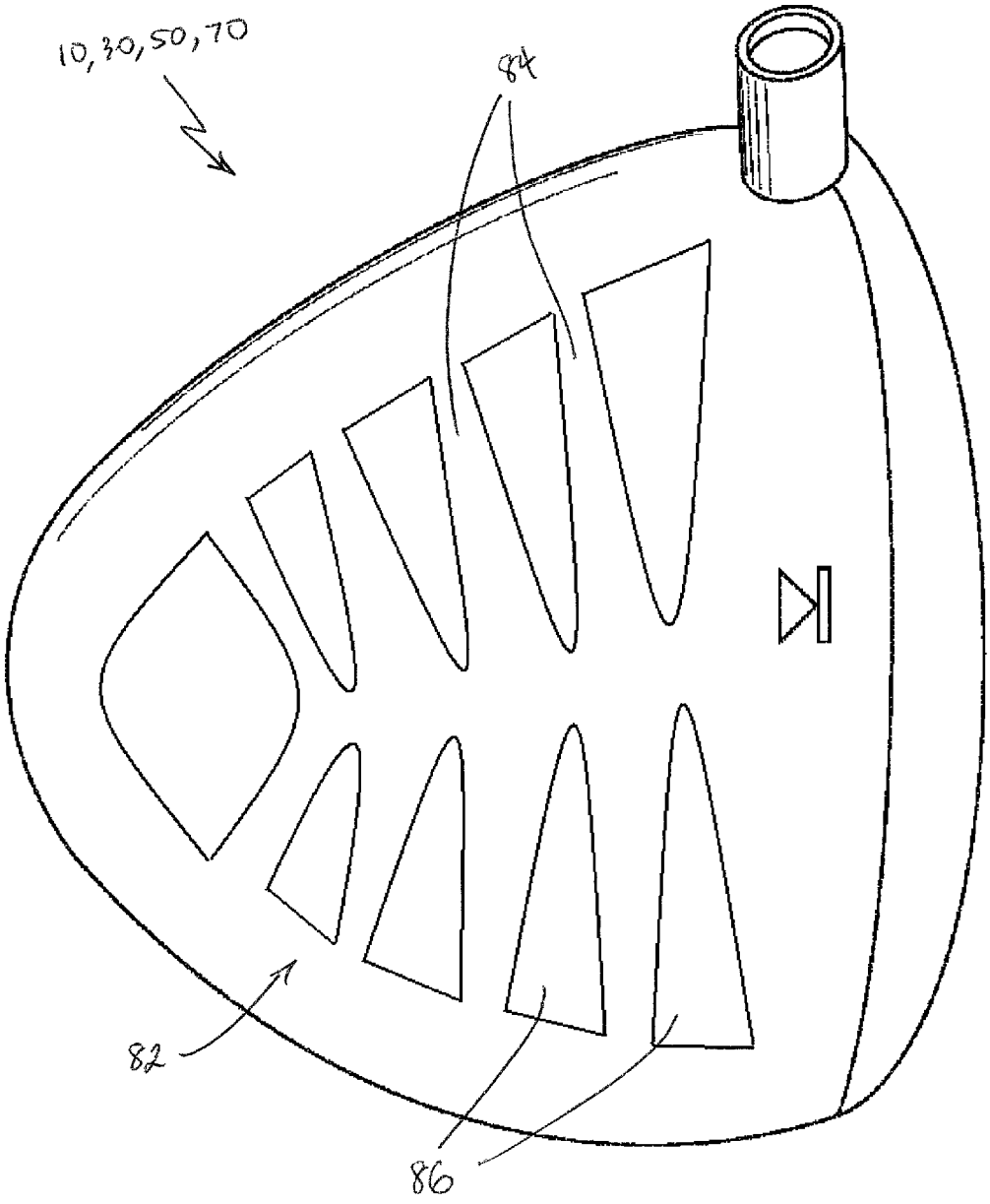
FIG. 18 is a top view of a club head showing a lightweight member.

FIG. 18 illustrates an exemplary embodiment or appearance of club head 10, 30, 50, 70 using lightweight materials. Club head 10, 30, 50, 70 has lightweight crown 82, which comprises relatively rigid ribs 84 preferably made out of metal or reinforced plastics and inserts 86 made from low specific gravity plastics. Ribs 84 provide structural supports for crown 82 and inserts 86 provide weight savings that can contribute to the discretionary weights A and B. In one embodiment, crown 82 comprises an inner crown made from lightweight material and an outer crown 84 with holes 86 punched therefrom.

While various descriptions of the present invention are described above, it should be understood that the various features of each embodiment could be used alone or in any combination thereof. Therefore, this invention is not to be limited to only the specifically preferred embodiments depicted herein. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A golf club comprising a shaft and a club head, wherein the club head comprises a y-axis running in a vertical direction through a geometric center of the club head and a hosel axis running parallel to a center of the shaft and through a hosel base, wherein a ratio of a MOI(y-axis) to a MOI (hosel axis) is greater than about 0.55, and wherein the MOI (hosel axis) is equal to or less than about 800 $kg \cdot mm^2$ and wherein the MOI(y-axis) is equal to or greater than about 470 $kg \cdot mm^2$.

2. The golf club of claim 1, wherein the MOI(hosel axis) is equal to or less than about 710 $kg \cdot mm^2$.

3. The golf club of claim 1, wherein the ratio of the MOI (y-axis) to the MOI(hosel axis) is greater than about 0.75.

4. The golf club of claim 3, wherein the ratio of the MOI (y-axis) to the MOI(hosel axis) is greater than about 1.0.

5. The golf club of claim 1, wherein the golf club is constructed from multiple materials.

6. The golf club of claim 5, wherein a ratio of the MOI(y-axis) to a volume of the club head is greater than about 1.30 $kg \cdot mm^2/cm^3$ for a club head having a volume of about 350 cc or greater.

7. The golf club of claim 6, wherein a ratio of the MOI(y-axis) to a volume of the club head is greater than about 1.50 $kg \cdot mm^2/cm^3$ for a club head having a volume of about 350 cc or greater.

8. The golf club of claim 7, wherein a ratio of the MOI(y-axis) to a volume of the club head is greater than about 1.70 $kg \cdot mm^2/cm^3$ for a club head having a volume of about 350 cc or greater.

9. The golf club of claim 5, wherein the club head has a horizontal bulge radius of about 12 inches and a vertical roll radius of about 10 inches if the MOI(y-axis) is greater than about 450 $kg \cdot mm^2$ and less than about 500 $kg \cdot mm^2$;

a horizontal bulge radius of about 13 inches and a vertical roll radius of about 10 inches if the MOI(y-axis) is greater than about 500 $kg \cdot mm^2$ and less than about 550 $kg \cdot mm^2$; and a horizontal bulge radius of about 14 inches and a vertical roll radius of about 10 inches if the MOI(y-axis) is greater than about 550 $kg \cdot mm^2$.

10. The golf club of claim 9, wherein the hitting face and a toe skirt wing of the club head form a hitting cup and an inner bridge connects a hosel to the toe-skirt wing to support the toe skirt wing.

11. The golf club of claim 9, wherein the club head comprises an outer shell and an inner frame disposed inside the outer shell and the inner frame is attached to a sole and a hitting face of the club head, and the inner frame is centered relative to the hitting face.

12. A golf club comprising a shaft and a club head, wherein the club head comprises a y-axis running in a vertical direction through a geometric center of the club head and a hosel axis running parallel to a center of the shaft and through a hosel base, wherein the club head has a horizontal bulge radius of about 12 inches and a vertical roll radius of about 10 inches if a MOI(y-axis) is greater than about 470 $kg \cdot mm^2$ and less than about 500 $kg \cdot mm^2$;

a horizontal bulge radius of about 13 inches and a vertical roll radius of about 10 inches if the MOI(y-axis) is greater than about 500 $kg \cdot mm^2$ and less than about 550 $kg \cdot mm^2$; and a horizontal bulge radius of about 14 inches and a vertical roll radius of about 10 inches if the MOI(y-axis) is greater than about 550 $kg \cdot mm^2$.

13. The golf club of claim 12, wherein a MOI (hosel axis) is equal to or less than about 800 $kg \cdot mm^2$ and wherein the MOI(y-axis) is equal to or greater than about 450 $kg \cdot mm^2$.

14. The golf club of claim 13, wherein the ratio of the MOI(y-axis) to the MOI (hosel axis) is greater than about 0.55.

15. The golf club of claim 12, wherein a ratio of the MOI (y-axis) to a volume of the club head is preferably greater than about 1.30 $kg \cdot mm^2/cm^3$ for a club head having a volume of about 350 cc or greater.

* * * * *